United States Patent [19]

Webb

[11] Patent Number: 4,586,306

[45] Date of Patent: May 6, 1986

[54] WINDOW ASSEMBLY AND GRILLE RETAINING STRIP HARDWARE THEREFOR

[75] Inventor: Dale P. Webb, Conneaut, Ohio

[73] Assignee: Webb Manufacturing, Inc., Conneaut, Ohio

[21] Appl. No.: 705,622

[22] Filed: Feb. 26, 1985

[51] Int. Cl.[4] ..... E06B 3/70

[52] U.S. Cl. ..... 52/311; 52/456

[58] Field of Search ..... 52/202, 311, 456, 717

[56] References Cited

U.S. PATENT DOCUMENTS

| | | | |
|---|---|---|---|
| 4,409,758 | 10/1983 | Dickerson et al. | 52/202 X |
| 4,437,284 | 3/1984 | Cribben et al. | 52/311 X |
| 4,454,691 | 6/1984 | Mitchell | 52/202 |

*Primary Examiner*—J. Karl Bell

*Attorney, Agent, or Firm*—Renner, Otto, Boisselle & Lyon

[57] ABSTRACT

A window assembly includes a sash with rails and stiles that define an opening. Glazing closes the opening and a grille covers the glazing. A retaining strip releasably attaches the grille to the sash. The retaining strip extends along substantially the entire length of at least two opposite sides of the window opening and is mounted on the rail or stile closely adjacent to the glazing. The strip hardware has an elongate V-shape formed of two substantially flat arms which connect to each other at an acute angle. One of the arms of the retaining strip is adhesively mounted to the rail or stile surface, and the other of the arms, the free arm, has a ridge or arch formed in the distal end portion which engages a groove in the outer peripheral edge of the grille.

9 Claims, 10 Drawing Figures

WINDOW ASSEMBLY AND GRILLE RETAINING STRIP HARDWARE THEREFOR

BACKGROUND OF THE INVENTION

Windows and doors, especially those with energy saving double glazing are often produced with a single large pane (or series of parallel panes) of glass. If the decorative effect of windows with many smaller panes is desired, a grille is attached to the inside of the window. This grille usually includes a frame with rails and stiles paralleling the rails and stiles of the window or door and cross members to imitate muntins.

Usually such grille is attached in a manner that allows easy removal. This facilitates cleaning of the window or removal of the grille in the event it is no longer wanted. One known prior art method of so attaching a grille is the use of spring loaded pins. The pins extend through the rails and stiles of the grille and engage a lip on a strike plate which is fastened to the corresponding rail or stile of the window sash. The strike plate may be secured in place either by an adhesive or by screws, depending on the material of which the rails and stiles are made. This method is primarily used where the sash is inclined 25° from perpendicular to the glass.

An alternative prior art method of attaching a grille to a sash involves the use of metal clips which are connected to the sash either by means of an adhesive or by means of a tab which can be forced parallel to the glass into the rail or stile. The metal clips are relatively short, about an inch long and located at several locations around the perimeter of the glazed opening, depending upon the size of the opening. This method is primarily used when the sash is inclined 10° from perpendicular to the glass.

Both techniques have had disadvantages. They are relatively expensive, and the pin and strike plate arrangement is particularly labor intensive. Because both prior art techniques engage the grille at only a few locations, the loading on the grille is fairly high at those points making installation and removal somewhat difficult. The locally high loads can also make it more likely that the grille will be broken during installation or removal. Further, the small space that remains between the grille and sash stile or rail between the clips may be considered by some to be unsightly.

SUMMARY OF THE INVENTION

The present invention provides a window assembly which includes a sash with rails and stiles that define an opening. Glazing closes the opening and a grille covers the glazing. Retaining strip hardware releasably attaches the grille to the sash. The retaining strip extends along substantially the entire length of at least two opposite sides of the window opening and is mounted on the rail or stile closely adjacent to the glazing. The retaining strip has an elongate V-shape formed of two substantially flat arms which connect to each other at an acute angle. One of the arms of the retaining strip is adhesively mounted to the rail or stile surface, and the other of the arms, the fulcrum arm, engages the outer peripheral edge of the grille. This peripheral edge of the grille has a groove formed in it and the distal end portion of the fulcrum arm of the retaining strip has a ridge or arch formed therein which engages the groove.

Because the retaining strip extends substantially the entire length of the rails, or stiles, or both, the force required to keep the grille in position is distributed over a much wider area, installation is facilitated and the possibility of breakage is reduced. Further, for the same reason it is possible to make the retaining strip hardware of the present invention of plastic rather than metal, greatly reducing the manufacturing cost. Because the retaining strip extends the entire length of rails or stiles, there are no unsightly spaces therebetween.

The invention, then, comprises the features hereinafter fully described and particularly pointed out in the claims, the following description and annexed drawings setting forth in detail illustrative embodiments of the invention, these being indicative, however, of but a few of the various ways in which the principles of the invention may be embodied.

DESCRIPTION OF PREFERRED EMBODIMENTS

Figure 1:
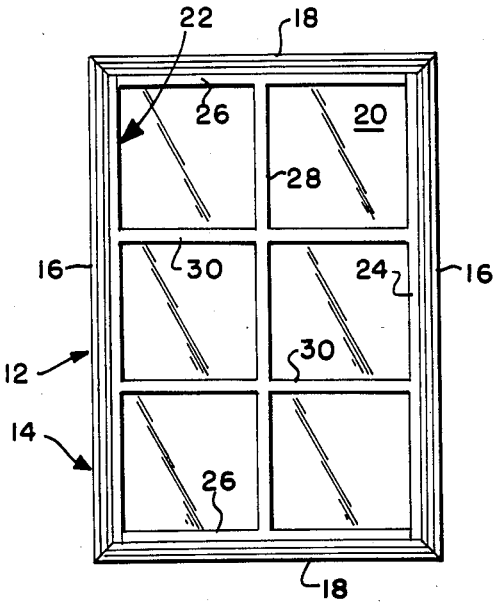
FIG. 1 is a front interior elevation view of a window assembly having a grille attached by means of retaining strip hardware constructed in accordance with the present invention.

The window assembly 12 illustrated in FIG. 1 includes a sash or frame 14 composed of vertical stiles 16 and horizontal rails 18. Glass 20, which may be a thermally insulating unit composed of two or more parallel sheets of glass with an evacuated or partially evacuated space between them, is mounted in a conventional manner to close the opening defined by the rails 18 and stiles 16. A grille 22 covers the glass 20 in imitation of the muntins of a sash with multiple panes.

Figure 2:
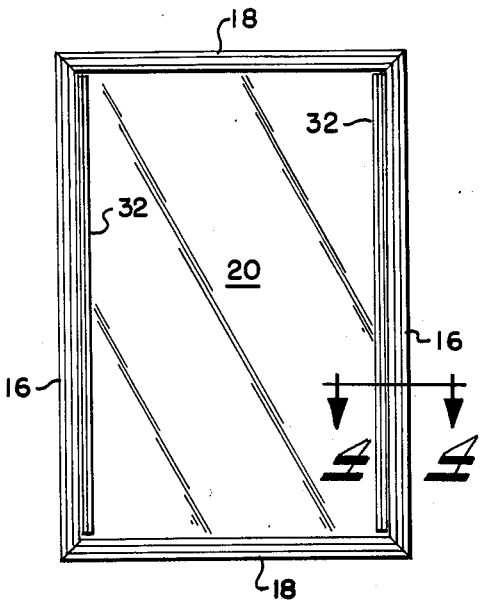
FIG. 2 shows the assembly of FIG. 1 with the grille removed.

The grille 22 includes a pair of vertical side members 24, a pair of horizontal members 26 connecting the top and bottoms of the vertical side members, and one or more vertical and horizontal dividers 28 and 30. The location and number of vertical and horizontal dividers 28 and 30 is variable according to style. The grille 22 is releasably secured in the frame 14 by means of retaining strips 32 (FIG. 2) constructed in accordance with this invention. The retaining strips 32 desirably extend substantially the entire length of the stiles 16. Since the two stiles 16 are on opposite sides of the window frame 14 and the retaining strips 32 are resilient, the retaining strips press against opposite sides of the grille 22 to hold it in place. The strip hardware of the present invention may also be utilized in windows that are not rectangular. For example, such strip hardware could be utilized in windows that are hexagonal. In this case two retaining strips 32 could be applied either to a single pair of frame members which are diametrically opposite or three retaining strips could be applied to alternate sides. In either case, forces applied by one retaining strip are balanced by the forces applied by the other(s), and the terms opposite, opposed and the like as used herein and in the claims are intended to encompass both types of application.

The stiles 16 of the window assembly 12 shown in FIGS. 1–5 include a surface 34 which is inclined approximately 10° from a plane perpendicular to the plane of the glass 20. This surface 34 is immediately adjacent the pane 20 with the exception of a small crease 36 which usually is about 3/32" in length. The retaining strip 32 (FIGS. 3 and 4) is formed of two arms 40, 42 which are generally planar strips and are joined together along one edge at 44. The arm 40 is preferably adhered to the surface 34 of the stile 16 by means of adhesive tape 46 with the end of the arm 40 remote from the joint 44 immediately adjacent or abutting the crease 36 or approximately 3/32" up off the glass and the open end 47 of the strip hardware facing the glass. If the retaining strips were inverted so that the joint 44 was flush with the glass, the fulcrum arm 42 would extend to a position that would obstruct normal insertion of the grille, thus essentially acting as a barrier to its installation. The adhesive tape 46 is of the type having an adhesive substance on both sides.

Figure 5:
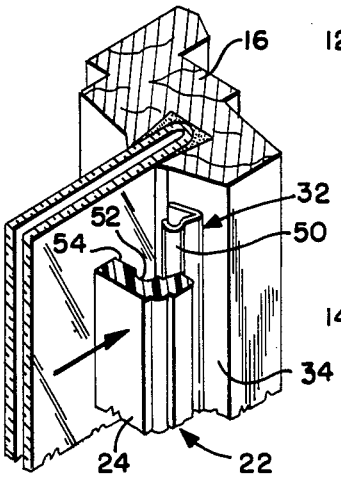
FIG. 5 is a view generally similar to FIG. 3 and also showing a portion of the grille prior to installation.

The free or fulcrum arm 42 is shaped to engage and retain the grille 22 in place. To this end the fulcrum arm 42 includes an arcuate ridge 50 at its distal end which extends the length of the retaining strip 32 parallel to the joint 44 and the plane of the glazing 20. As shown in FIG. 5 the side rail 24 of the grille 22 includes a groove 52 formed in face 54 which forms the edge of the grille facing surface 34 of the stile 16. This groove 52 extends the entire length of the vertical side member 24 and is adapted to receive the arcuate ridge 50 of the retaining strip 32. The width of the arms 40 and 42 as well as the proportions of the side members 24 are selected so that when the ridge 50 is received in the groove 52, the grille is securely held in place closely adjacent the glass 20.

The retaining strip 32 is formed of a resilient plastic material, and in an unloaded or unstressed state the two arms 40 and 42 form an angle of approximately 30° to each other. Each of the arms may be about 0.018" thick and have a width of about 0.400". Accordingly, it is easy to resiliently bias the fulcrum arm 42 toward the stationary arm 40 about the fulcrum defined by the joint 44 as is necessary when installing the grille.

In a preferred embodiment, the arcuate ridge 50 is semi-circular and may have an outside radius of approximately 0.094", and the center of curvature is an axis running parallel to the joint 44 lying in the plane of the outside surface 54 of the arm 42. The groove 52 in the grille is similarly shaped to snugly receive the ridge 50.

Figure 6:
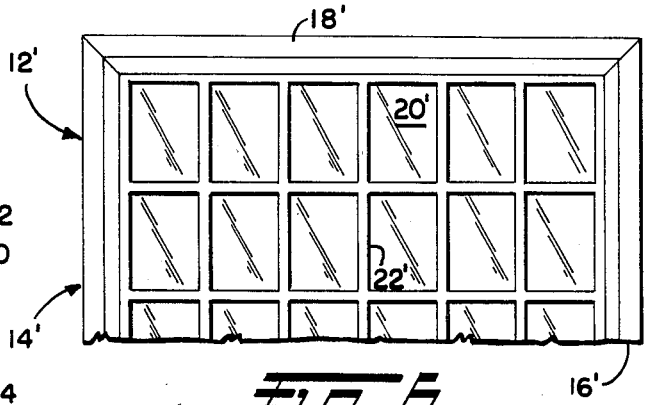
FIG. 6 is a partial front elevation view of another window assembly constructed in accordance with the present invention having a grille attached to the window sash by means of retaining strips in accordance with this invention.

FIG. 6 illustrates a second embodiment of the present invention. Because the embodiments are similar in many respects, similar reference numerals with a ′ (prime) added will be used to designate similar parts, and only the differences between the parts and those described in connection with FIGS. 1–5 will be pointed out, it being clear to one of ordinary skill in the art that the corresponding parts function in the same way in each embodiment. Because the retaining strip 32 is identical, no ′ (prime) is added to it or the numerals designating its various parts.

Figure 7:
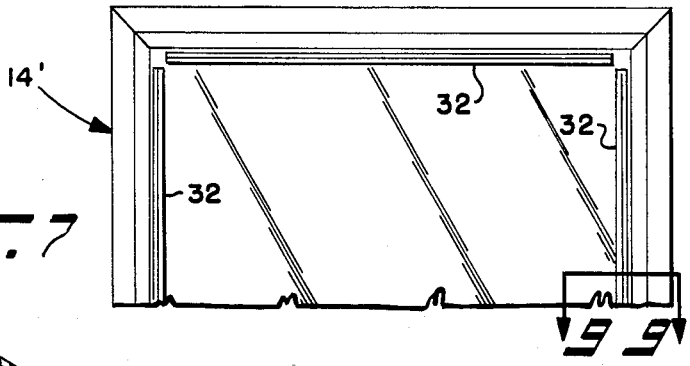
FIG. 7 shows the window of FIG. 6 with the grille removed.

The window assembly 12′ (FIG. 6) is substantially larger than the window assembly previously described, and includes a frame 14′ composed of rails 18′ and stiles 16′ which support by means of retaining strips 32 (FIG. 7) a grille 22′. Because of the increased size of the window assembly 12′, retaining strips 32 may be mounted on the rails 18′ as well as the stiles 16′, and desirably extend substantially the entire length thereof. In FIG. 7, only three retaining strips 32 are shown. However, it will be readily understood that a fourth retaining strip may extend substantially the entire length of the rail which is not shown but which forms the bottom of frame 14′.

In the window assembly shown in FIGS. 6–10, the surface 34′ of the sash 14′ is disposed at approximately a 25° angle to a plane normal to the plane of the glass 20′. Because of such angle, the retaining strip 32 (FIG. 8) is installed with the joint 44 flush with the glass 20′. If the retaining strips were inverted so that the open end 47 was facing the glass as shown in FIGS. 3 and 4, the fulcrum arm 42 would extend in a position preventing the grille from being easily removed and essentially locking the grille to the window assembly.

Figure 3:
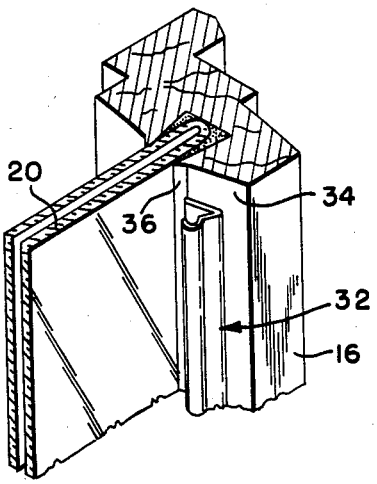
FIG. 3 is an enlarged perspective, sectional view of a part of the window of FIG. 2 showing a portion of the retaining strip mounted to a stile surface of the window.
Figure 4:
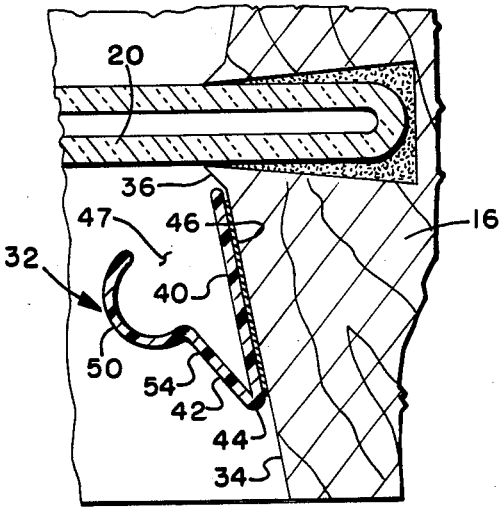
FIG. 4 is an enlarged fragmentary transverse section through the window assembly of FIG. 2 taken on the plane of the line 4—4 thereof.
Figure 8:
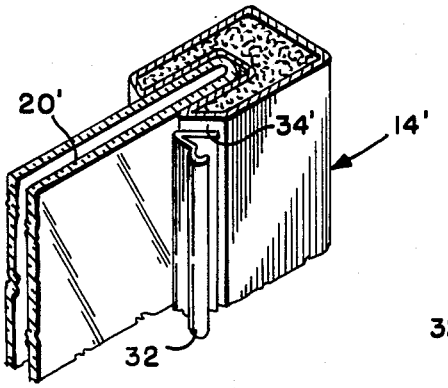
FIG. 8 is a perspective, sectional view of the window assembly of FIG. 7 showing the retaining strip mounted to a stile surface in an orientation reversed from that illustrated in FIG. 3.
Figure 9:
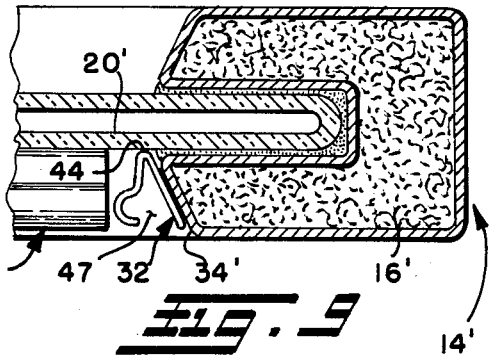
FIG. 9 is an enlarged partial sectional view through the assembly of FIG. 7 looking in the direction of the arrows 9—9 of FIG. 7.
Figure 10:
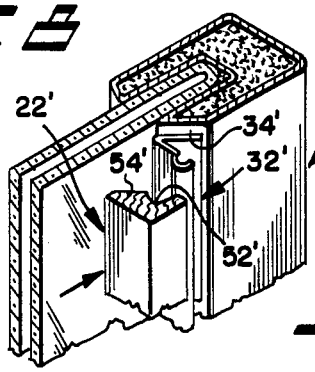
FIG. 10 is similar to FIG. 8 and also shows a portion of the grille during installation.

From the foregoing, it will be apparent that the strip hardware 32 of the present invention may be installed either with the joint 44 "pointing" away from the glazing 20 as shown in FIGS. 3–5 or may be positioned as shown in FIGS. 8–10 with the joint 44 flush with the glass 20′. Thus the strip hardware 32 performs the functions which in the past were required to be performed by two entirely different types of attachment means.

Although the preceding description has described the present invention in connection with grilles to be installed on the sashes of windows, it will be readily apparent to those of ordinary skill in the art that the invention is equally applicable to sliding glass doors or other kinds of doors. Thus, although the claims are phrased in terms of windows, as used therein the term "window" should be readily understood to include doors as well.

Moreover, although the invention has been shown and described with respect to certain preferred embodiments, it is obvious that equivalent alterations and modifications will occur to others skilled in the art upon the reading and understanding of the specification. The present invention includes all such equivalent alterations and modifications, and is limited only by the scope of the claims.

The following is claimed:

1. A retaining strip for attaching a decorative grille to the periphery of a glass-closed opening in a window, the grille having a mounting surface transverse to the plane of the opening and a peripheral groove in the mounting surface, and the window including opposed peripheral surfaces surrounding the opening, such opposed peripheral surfaces extending transverse to the plane of the opening, said retaining strip being provided to extend substantially the entire length of at least two of said opposed peripheral surfaces of the window, said retaining strip comprising a first generally planar arm, adhesive means for adhering said first arm to such opposed peripheral transverse surfaces of the window adjacent the glass, a second arm extending at an acute angle to the first arm, and having an arch at the distal end thereof for gripping the groove in the grille, and resilient connection means between said first and second arms for urging said arch on said second arm into engagement with the peripheral groove in the grille, said second arm having a generally planar portion between said resilient connection means with said first arm and said arch, said arch having a substantially uniform radius with a center of curvature substantially lying in the plane defined by said second arm.

2. The strip of claim 1 wherein said adhesive means includes an adhesive tape having adhesive material on opposite sides for adhering to such opposed peripheral transverse surfaces of the window and to said first arm, respectively.

3. The strip of claim 1 wherein said arms form an angle of approximately 30° to each other.

4. The strip of claim 1 wherein said strip of made of a flexible plastic.

5. A window assembly comprising a sash having an opening, glazing closing said opening, a grille covering said glazing, and retaining means for releasably attaching said grille to said sash, said sash having opposed peripheral surfaces transverse to the plane of the glazing, said grille having surfaces containing a groove facing said opposed peripheral surfaces of said sash and extending parallel to the plane of the glazing, said retaining means including flexible retaining strip means between said parallel surfaces of said sash and grille and extending substantially the entire length thereof, said retaining strip means having a ridge adapted to fit said groove, means for resiliently urging said ridge into engagement with said groove, and means for securing said retaining strip means to said opposed peripheral surfaces of said sash, said means for resiliently urging said ridge including first and second resilient plastic arms connected to each other at one end to provide a closed end, said arms being spaced apart from each other at the ends opposite said closed end to provide an open end, said arms forming an acute angle to each other, one of said arms being secured to said opposed peripheral surface of said sash, and the other of said arms having said ridge therein adjacent the open end of said retaining strip means, said ridge having a substantially uniform radius with a center of curvature substantially lying in the plane of said second arm.

6. The assembly of claim 5 wherein said arms form an acute angle to each other of approximately 30°.

7. The assembly of claim 6 wherein said opposed peripheral surfaces of said sash are inclined approximately 10° from a plane perpendicular to the plane of said glazing, and the open end of said retaining strip means is facing said glazing.

8. The assembly of claim 7 wherein the end of said one arm remote from said closed end is located approximately 3/32" from said glazing.

9. The assembly of claim 6 wherein said opposed peripheral surfaces of said sash are inclined approximately 25° from a plane perpendicular to the plane of said glazing, and the closed end of said retaining strip means is flush with said glazing.

* * * * *